US005802632A

United States Patent [19]

Campbell

[11] Patent Number: 5,802,632

[45] Date of Patent: Sep. 8, 1998

[54] PATIENT TRANSFERRING APPARATUS

[76] Inventor: Jerry L. Campbell, 15 Oakwood Rd., Winter Haven, Fla. 33880

[21] Appl. No.: 597,834

[22] Filed: Feb. 7, 1996

[51] Int. Cl.[6] ..... A61G 7/08

[52] U.S. Cl. ..... 5/81.1 C; 198/321

[58] Field of Search ..... 5/81.1 C, 81.1 HS, 5/81.1 T, 81.1 R; 198/321, 841

[56] References Cited

U.S. PATENT DOCUMENTS 2,918,681 12/1959 Davis ..... 5/81.1 C
3,792,500 2/1974 Swara, Sr. ..... 5/81.1 R
4,297,753 11/1981 Langren ..... 5/81.1 C
4,967,427 11/1990 Cherepy, Sr. ..... 5/81.1 C
5,152,016 10/1992 Becker ..... 5/81.1 HS

*Primary Examiner*—Alexander Grosz

[57] ABSTRACT

A patient transferring apparatus comprised of an elongated board portion having a flat bottom level and two side walls extending upwardly from opposing side edges of the flat bottom level. The flat bottom level and the two side walls define a pair of end portions. The elongated board portion has a top level secured between the two side walls tangential to the flat bottom level. A pair of rollers are rotatably secured within each of the pair of end portions of the elongated board portion. An endless belt extends about the pair of rollers and being movable with respect to the pair of rollers.

3 Claims, 4 Drawing Sheets

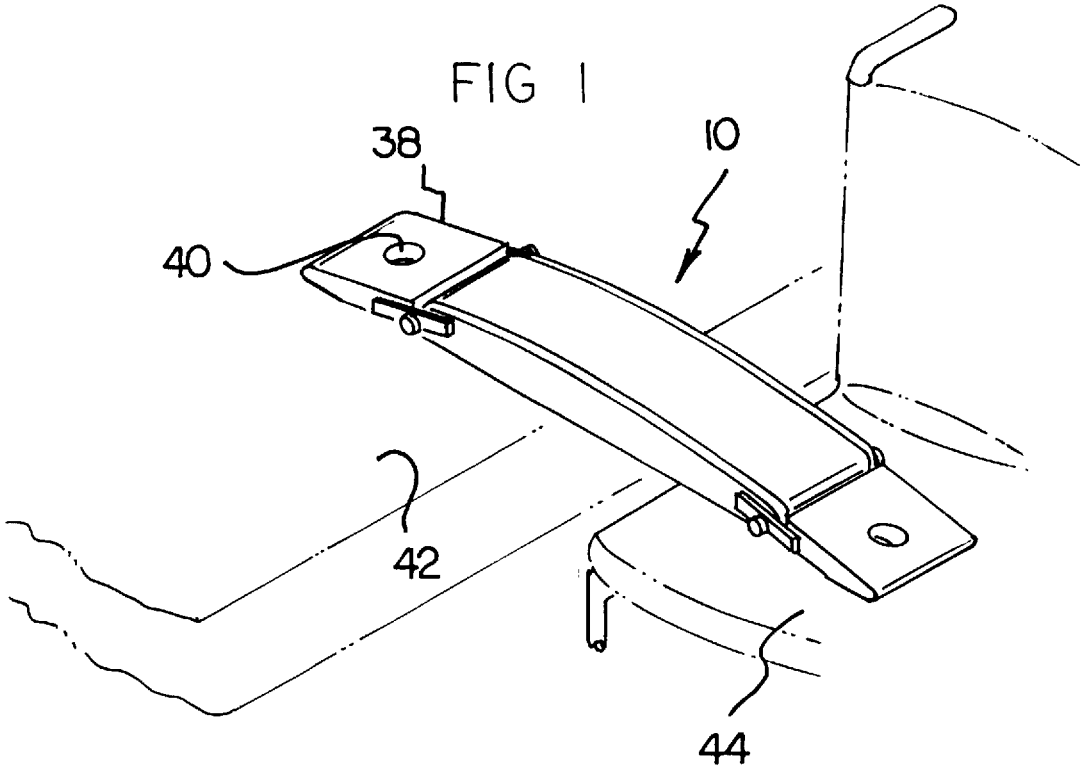
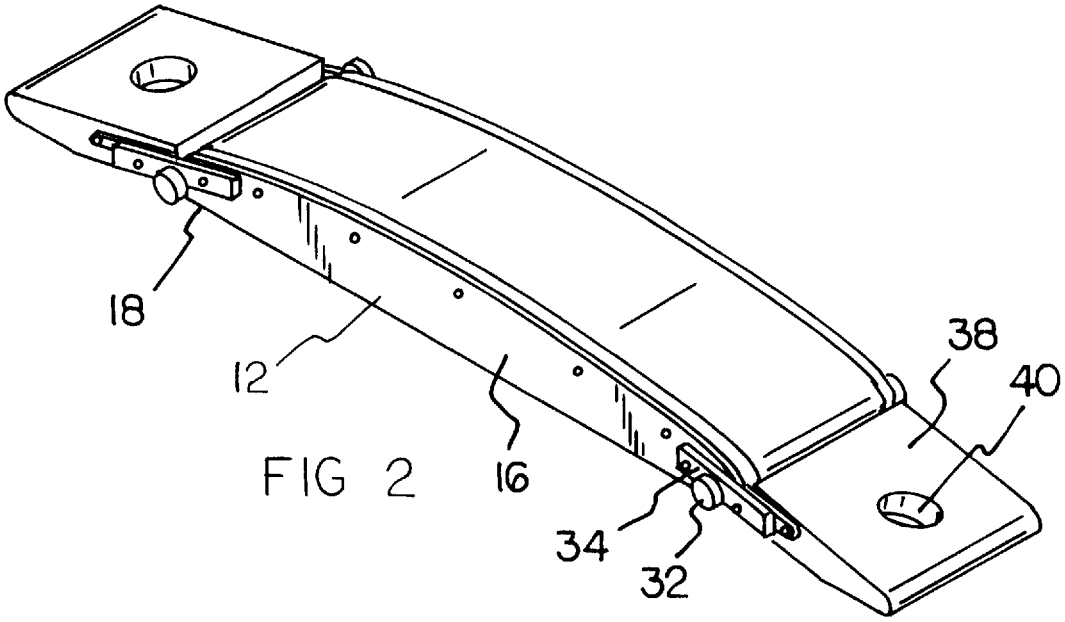
FIG 2

FIG 3
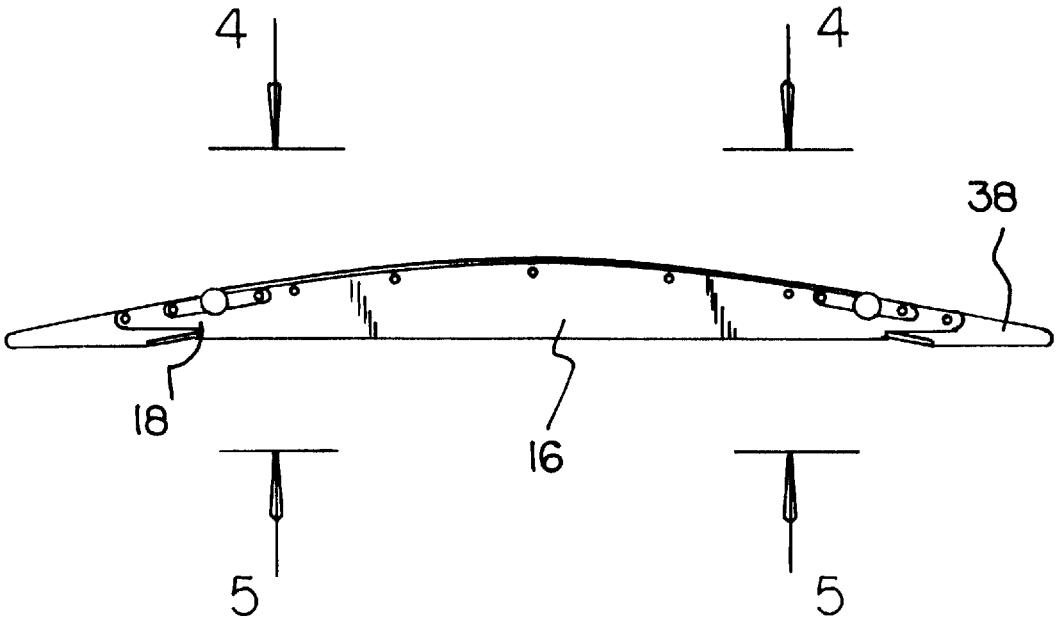
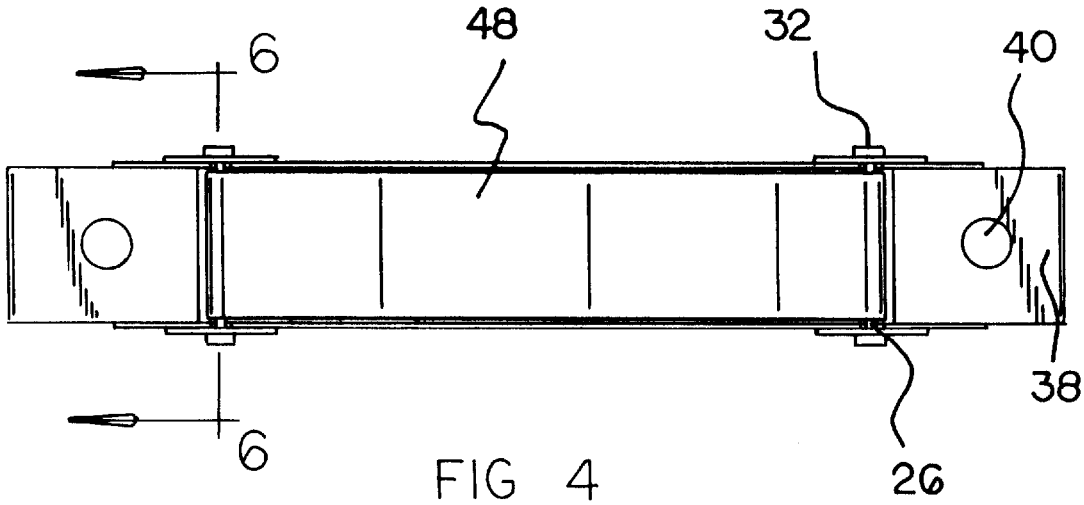
FIG 4

FIG 5
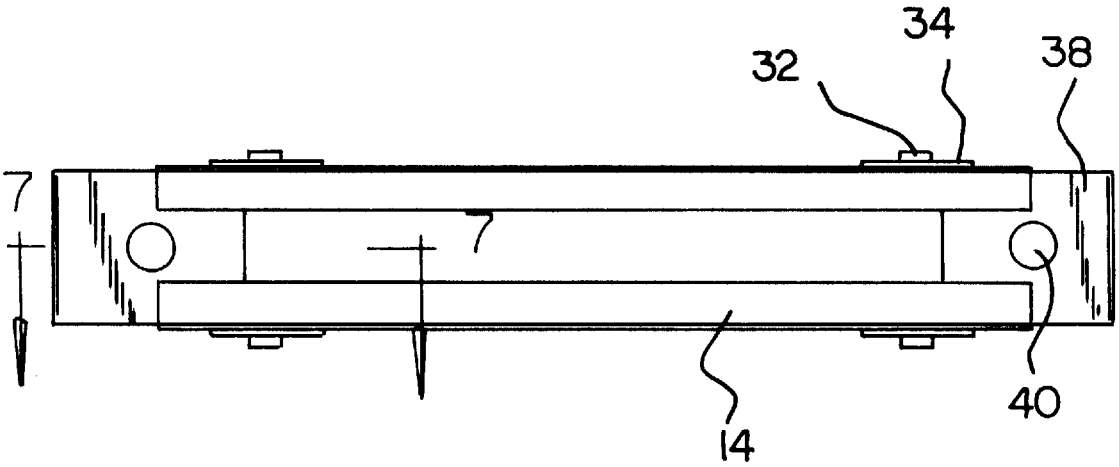
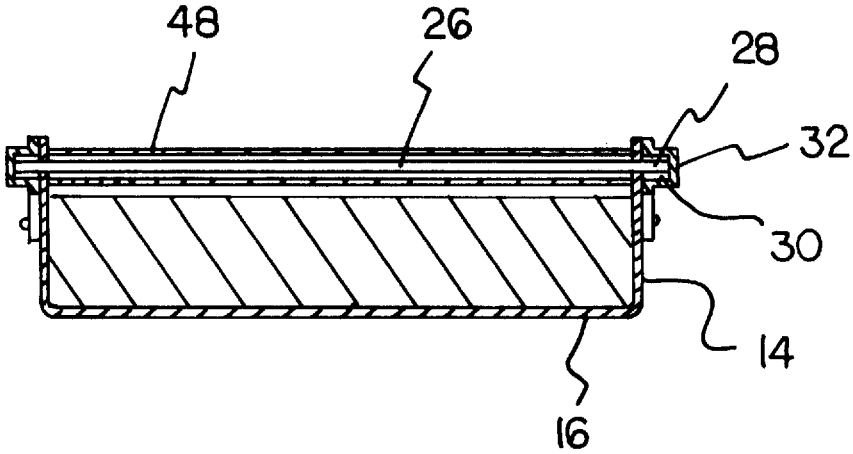
FIG 6

PATIENT TRANSFERRING APPARATUS

BACKGROUND OF THE INVENTION

1. Field of the Invention

The present invention relates to a patient transferring apparatus and more particularly pertains to assisting in moving a patient from a bed to a wheel chair and back again with a patient transferring apparatus.

2. Description of the Prior Art

The use of transfer boards is known in the prior art. More specifically, transfer boards heretofore devised and utilized for the purpose of transferring a patient from one position to another are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,271,110 to Newman discloses a patient transfer device.

U.S. Pat. No. 5,152,016 to Becker discloses a transfer board.

U.S. Pat. No. 4,967,427 to Cherepy, Sr. discloses a patient conveyor assembly.

U.S. Pat. No. 4,644,594 to Johnson discloses a patient transport device.

U.S. Pat. No. 3,962,736 to Fedele discloses a device for moving or positioning a patient in a bed.

While these devices fulfill their respective, particular objective and requirements, the aforementioned patents do not describe a patient transferring apparatus for assisting in moving a patient from a bed to a wheel chair and back again.

In this respect, the patient transferring apparatus according to the present invention substantially departs from the conventional concepts and designs of the prior art, and in doing so provides an apparatus primarily developed for the purpose of assisting in moving a patient from a bed to a wheel chair and back again.

Therefore, it can be appreciated that there exists a continuing need for new and improved patient transferring apparatus which can be used for assisting in moving a patient from a bed to a wheel chair and back again. In this regard, the present invention substantially fulfills this need.

SUMMARY OF THE INVENTION

In the view of the foregoing disadvantages inherent in the known types of transfer boards now present in the prior art, the present invention provides an improved patient transferring apparatus. As such, the general purpose of the present invention, which will be described subsequently in greater detail, is to provide a new and improved patient transferring apparatus and method which has all the advantages of the prior art and none of the disadvantages.

To attain this, the present invention essentially comprises an elongated board portion having a flat bottom level and two side walls extending upwardly from opposing side edges of the flat bottom level. The two side walls have thin end portions and wider intermediate portions. The flat bottom level and the two side walls together define a pair of end portions. The elongated board portion has a top level secured between the two side walls, spaced upwardly from, and generally parallel to the flat bottom level. The device contains a pair of rollers. Each of the rollers has a shaft portion. The shaft portion is rotatably secured within each of the pair of end portions of the elongated board portion. The shaft portion has end portions extending outwardly of the two side walls of the elongated board portion. The end portions of the shafts have ball bearings coupled thereto by a cap. The cap has extension portions secured to the two side walls of the elongated board portion. The device contains a pair of end plates secured to the pair of end portions of the elongated board portion. Each of the pair of end plates has a finger hole formed therethrough. The pair of end plates extend the elongated board portion for securement between a bed and a wheel chair. The device contains an endless belt extending about the shaft portions of the pair of rollers and being movable with respect to the pair of rollers.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved patient transferring apparatus which has all the advantages of the prior art transfer boards and none of the disadvantages.

It is another object of the present invention to provide a new and improved patient transferring apparatus which may be easily and efficiently manufactured and marketed.

It is a further object of the present invention to provide a new and improved patient transferring apparatus which is of durable and reliable construction.

An even further object of the present invention is to provide a new and improved patient transferring apparatus which is susceptible of a low cost of manufacture with regard to both materials and labor, and which accordingly is then susceptible of low prices of sale to the consuming public, thereby making such a patient transferring apparatus economically available to the buying public.

Still yet another object of the present invention is to provide a new and improved patient transferring apparatus which provides in the apparatuses and methods of the prior art some of the advantages thereof, while simultaneously overcoming some of the disadvantages normally associated therewith.

Even still another object of the present invention is to provide a new and improved patient transferring apparatus for assisting in moving a patient from a bed to a wheel chair and back again.

Lastly, it is an object of the present invention to provide a new and improved patient transferring apparatus comprised of an elongated board portion having a flat bottom level and two side walls extending upwardly from opposing side edges of the flat bottom level. The flat bottom level and the two side walls define a pair of end portions. The elongated board portion has a top level secured between the two side walls tangential to the flat bottom level. A pair of rollers are rotatably secured within each of the pair of end portions of the elongated board portion. An endless belt extends about the pair of rollers and being movable with respect to the pair of rollers.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the present invention in place between a bed and a wheel chair.

FIG. 2 is a perspective view of the preferred embodiment of the patient transferring apparatus constructed in accordance with the principles of the present invention.

FIG. 3 is a side elevation view of the present invention.

FIG. 4 is a plan view of the preferred embodiment of the present invention.

FIG. 5 is an inverted view of the present invention taken along line 5—5 of FIG. 3.

FIG. 6 is a cross-sectional view as taken along line 6—6 of FIG. 4.

The same reference numerals refer to the same parts through the various Figures.

DESCRIPTION OF THE PREFERRED EMBODIMENT

Figure 7:
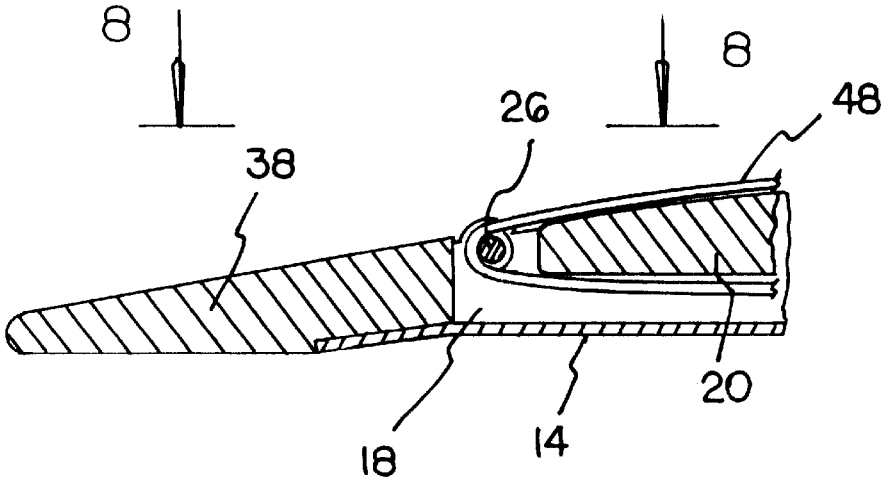
FIG. 7 is a cross-sectional view as taken along line 7—7 of FIG. 5.
Figure 8:
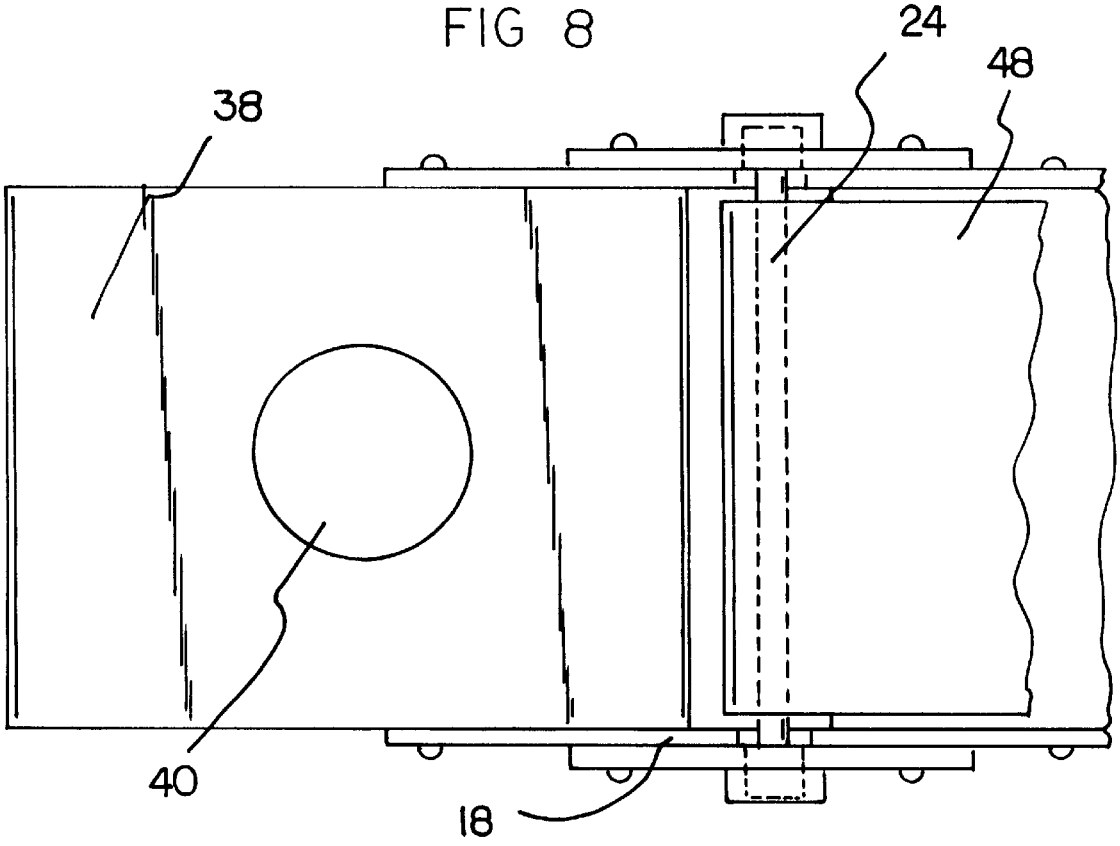
FIG. 8 is a plan view as taken along line 8—8 of FIG. 7.

With reference now to the drawings, and in particular, to FIG. 1–8 thereof, the preferred embodiment of the new and improved patient transferring apparatus embodying the principles and concepts of the present invention and generally designated by the reference number 10 will be described.

Specifically, it will be noted in the various Figures that the device relates to a new and improved patient transferring apparatus for assisting in moving a patient from a bed to a wheel chair and back again. In its broadest context, the device consists of an elongated board portion, a pair of rollers, a pair of end plates, and an endless belt.

The device 10 contains an elongated board portion 12 having a flat bottom level 14 and two side walls 16 extending upwardly from opposing side edges of the flat bottom level 14. The two side walls 16 have thin end portions and wider intermediate portions. The flat bottom level 14 and the two side walls 16 together define a pair of end portions 18. The elongated board portion 12 has a top level 20 secured between the two side walls 16, spaced upwardly from, and generally parallel to the flat bottom level 14.

The device 10 contains a pair of rollers 24. Each of the rollers 24 has a shaft portion 26. The shaft portion 26 is rotatably secured within each of the pair of end portions 18 of the elongated board portion 12. The shaft portion 26 has end portions 28 extending outwardly of the two side walls 16 of the elongated board portion 12. The end portions 28 of the shafts 26 have ball bearings 30 coupled thereto by a cap 32. The cap 32 has extension portions 34 secured to the two side walls 16 of the elongated board portion 12.

The device 10 contains a pair of end plates 38 secured to the pair of end portions 18 of the elongated board portion 12. Each of the pair of end plates 38 has a finger hole 40 formed therethrough. The pair of end plates 38 extend the elongated board portion 12 for securement between a bed 42 and a wheel chair 44. The device 10 is positioned between the bed 42 and the chair 44 with one of the pair of end plates 38 positioned underneath a patient.

The device 10 contains an endless belt 48 extending about the shaft portions 26 of the pair of rollers 24 and being movable with respect to the pair of rollers 24. After the patient is positioned atop one of the pair of end plates 38, he/she then slides atop the endless belt 48. The endless belt 48 will then roll in respect to the pair of rollers 24 thereby transporting the patient to the wheel chair 44. The endless belt 48 is fabricated out of rubber or a resilient plastic material.

The present invention is a transfer board that assists in moving a patient from a bed 42 to a wheel chair 44 and back again, with relatively effort.

The board is similar to a conveyor belt, with ball bearing rollers 30 at each end, mounted on an aluminum track with two parallel layers. A rubber or plastic endless belt 48 slides across the top level 20 and passes beneath and around it. The track extends beyond the belt 48 on each end, with finger holes 40 for easier maneuvering. A typical unit is about seven inches in width and thirty inches in length.

The patient sits up, cooperating in allowing one end of the board 12 to be placed underneath them. With or without assistance, the person is then able to push and pull against the bed 42, rotating the belt 48 around the rollers 24, carrying them to the opposite end that rests on the seat of the wheel chair 44, enabling them to enter it. The same technique is used to return them to the bed 42.

This device 10 is much easier to use than plain transfer boards which require the patient to slide. It places less stress on the person, requires considerably less help from an assistant, and should help to prevent dropping the patient. Heavy people who would otherwise pose a serious problem when they must be transferred, are able to accomplish the moving without excessive effort.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A patient transferring apparatus for assisting in moving a patient from a bed to a wheel chair and back again comprising, in combination:

an elongated board portion having a flat bottom level and two side walls extending upwardly from opposing side edges of the flat bottom level, the two side walls having thin end portions and wider intermediate portions, the flat bottom level and the two side walls defining a pair of end portions, the elongated board portion having a top level secured between the two side walls, spaced upwardly from, and generally parallel to the flat bottom level;

a pair of rollers, each of the rollers having a shaft portion, the shaft portion rotatably secured within each of the pair of end portions of the elongated board portion, the shaft portion having end portions extending outwardly of the two side walls of the elongated board portion, the end portions of the shafts having ball bearings coupled thereto by a cap, the cap having extension portions secured to the two side walls of the elongated board portion;

a pair of end plates secured to the pair of end portions of the elongated board portion, each of the pair of end plates having a finger hole formed therethrough, the pair of end plates extending the elongated board portion for securement between a bed and a wheel chair;

an endless belt extending about the shaft portions of the pair of rollers and being movable with respect to the pair of rollers.

2. The apparatus as described in claim 1 wherein the endless belt is fabricated of rubber.

3. The apparatus as described in claim 1 wherein the endless belt is fabricated of resilient plastic.

* * * * *